US005890426A

United States Patent [19]

Gumkowski

[11] Patent Number: 5,890,426

[45] Date of Patent: Apr. 6, 1999

[54] FIBER BALING APPARATUS

[75] Inventor: John Gumkowski, Corvallis, Oreg.

[73] Assignee: Evanite Fiber Corporation, Corvallis, Oreg.

[21] Appl. No.: 848,937

[22] Filed: May 1, 1997

[51] Int. Cl.[6] ..... B30B 15/30

[52] U.S. Cl. ..... 100/45; 100/90; 100/99; 100/215

[58] Field of Search ..... 100/45, 49, 90, 100/99, 72, 215, 232

[56] References Cited

U.S. PATENT DOCUMENTS

| | | | |
|---|---|---|---|
| Re. 31,944 | 7/1985 | Strömberg . | |
| 2,682,139 | 6/1954 | Cox . | |
| 3,133,563 | 5/1964 | Smith . | |
| 3,161,124 | 12/1964 | Stromberg | 100/99 |
| 3,266,096 | 8/1966 | Thomas et al. | 100/99 |
| 3,583,312 | 6/1971 | Van Doorn et al. | 100/215 |
| 3,818,673 | 6/1974 | Rollins et al. . | |
| 4,040,230 | 8/1977 | Pessel et al. | 100/99 |
| 4,075,942 | 2/1978 | Johnson, Jr. | 100/215 |
| 4,162,603 | 7/1979 | Strömberg . | |
| 4,263,844 | 4/1981 | Hacking | 100/215 |
| 4,318,264 | 3/1982 | Rewitzer . | |
| 4,372,101 | 2/1983 | Fleissner . | |
| 4,407,107 | 10/1983 | Smith, Jr. . | |
| 4,408,438 | 10/1983 | Rewitzer . | |
| 4,526,094 | 7/1985 | Rewitzer | 100/49 |
| 5,074,101 | 12/1991 | Rewitzer . | |
| 5,111,741 | 5/1992 | Weder et al. | 100/49 |
| 5,226,269 | 7/1993 | Stoltenberg . | |
| 5,415,738 | 5/1995 | Mehta et al. . | |

FOREIGN PATENT DOCUMENTS

| | | | |
|---|---|---|---|
| 60-72698 | 4/1985 | Japan | 100/99 |

*Primary Examiner*—Stephen F. Gerrity
*Attorney, Agent, or Firm*—Klarquist Sparkman Campbell Leigh & Whinston, LLP

[57] ABSTRACT

A fully automated, microprocessor controlled, fiber baling apparatus for converting loose, discontinuous fibers into compressed, high-density fiber bales is disclosed. The fiber baling apparatus produces fiber bales having preselected and substantially identical masses with weight tolerances below one percent of the total bale weight. The fiber baling apparatus includes a conveyor located downstream of a fiber-forming chain, a baler having a first hopper, a second hopper mounted on a scale and a compression assembly, a bagger/strapper assembly, a bag sealer, and a bale lifting system. The fiber baling apparatus separates the fibers into separate mat portions rather than operating to form bales from a continuous stream of fibers. The separate mat portions of fiber are transported by conveyor to the baler and the fiber mat portions are weighed, precompressed, and fully compressed into fiber bales.

16 Claims, 4 Drawing Sheets

10
84
86
86a
86b
96a
96b
20
24
56
18
50
14
16
54
28
52
30
SCALE
86b
26
58
96c
MICRO-
PROCESSOR
52a
52b
60
62
32
96d
12
22
68
TO 38
72
66
34
48

FIBER BALING APPARATUS

FIELD OF THE INVENTION

The present invention concerns methods and apparatus for baling loose, discontinuous fibers, such as glass or synthetic polymer fibers. More particularly, the present invention pertains to methods and apparatus for baling fibers into bales having precise and substantially identical, preselected masses.

BACKGROUND AND SUMMARY OF THE INVENTION

It is generally known to deposit loose fiber material in containers, compress the fibers into bales, and package the fiber bales by bagging and/or strapping the bales. Some systems employ on-line weighing apparatus to approximate the mass value the resulting fiber bale. Such systems form bales from a continuous mat or stream of fibers. The total mass value of the fibers to be compressed into a single bale is assessed as the stream of fibers is continuously delivered to a scale. As a consequence, known fiber baling systems provide only a rough assessment of the fiber bale mass value. Hence, known systems provide fiber bales along with imprecise mass values. Additionally, the fiber bale masses vary significantly from bale to bale.

Many processes utilizing such fiber materials require the materials be introduced in precise mass quantities. Consequently, the fiber material must be weighed prior to introduction to such processes. Fiber bales having precise and substantially identical, preselected masses (i.e., bales of close weight tolerances) would allow such processes to bypass the often expensive and time consuming weighing procedures. Thus, there is a need for fiber baling apparatus and methods that ensure formation of fiber bales, having precise and substantially identical preselected masses of fiber material.

Systems that bale loose fiber materials in an automated (i.e., timed), sequential manner are also known. Such conventional systems run each subassembly of the baling apparatus in timed sequence. For example, U.S. Pat. No. 4,162,603 discloses a baling apparatus wherein a continuous stream of fibrous material is caused to fall into a shaft in which a pressing operation takes place. A sequence of pre-compression and compression by movement of various compression forks and hopper gates takes place in a timed manner. The timing is based solely on the initial falling speed of the fiber as the material flows down the first shaft. As a result of the timed sequence, timing of subassemblies of the system may not be changed (e.g., hurried, slowed or stopped) irrespective of the timing of other subassemblies.

The fiber baling apparatus of the present invention is a fully automated, microprocessor controlled system for converting loose, discontinuous fibers into compressed, high-density fiber bales. The fiber baling apparatus can be adjusted to produce fiber bales having preselected masses and dimensions, with weight tolerances below one percent of the total bale weight.

The fiber baling apparatus of the present invention comprises a conveyor located downstream of a fiber-forming chain, a baler having a first hopper, a second hopper mounted on a scale and a compression assembly, a bagger/strapper, a bag sealer, and a bale lifting system. The fiber baling apparatus separates the fibers into separate mat portions that are formed into bales, rather than operating to form bales from a continuous stream of fibers. The separate mat portions of fiber are transported by conveyor to the baler. An alternative embodiment of the present invention includes a third conveyor positioned downstream of the bag sealer, and a bale lifting system for placing bagged, strapped, and sealed fiber bales on a pallet for shipping and/or storage.

In a preferred method of the present invention, the baler cyclically weighs incoming mat portions of fiber until a preselected, partial mass value is reached. The mat portions are then delivered to the compression assembly and precompressed. The delivery, weighing, and precompression cycle continues until fiber delivered to the second hopper, and then precompressed in the compression assembly, equals a preselected total mass value. The fiber is then fully compressed, bagged, and strapped. The bagged and strapped fiber bale is then moved on a third conveyor to a bag sealer. After the bag is sealed, the bale is lifted by an automatic lifting system and placed on a pallet to await shipment. Fugitive-dust emanating from various locations in the baling apparatus is removed by a dust-collection system and transported back to be recycled into the next fibers produced.

The method and apparatus of the present invention is fully automated and is controlled by a process controller or microprocessor. Accordingly, operation of any subassembly of the system may be changed (e.g., hurried, slowed or stopped) irrespective of operation speed of the other subassemblies, to produce fiber bales having precise and substantially identical mass values. Additionally, the preselected partial mass value or the preselected total mass value may be changed at any point during operation.

The method and apparatus of the present invention reduces the amount of physical effort required of an operator, reduces the operator's risk of injury, reduces risk of fiber contamination, reduces bale-weight tolerances, reduces the amount of fugitive-dust in the environment, and increases production speed.

DETAILED DESCRIPTION

Figure 1:
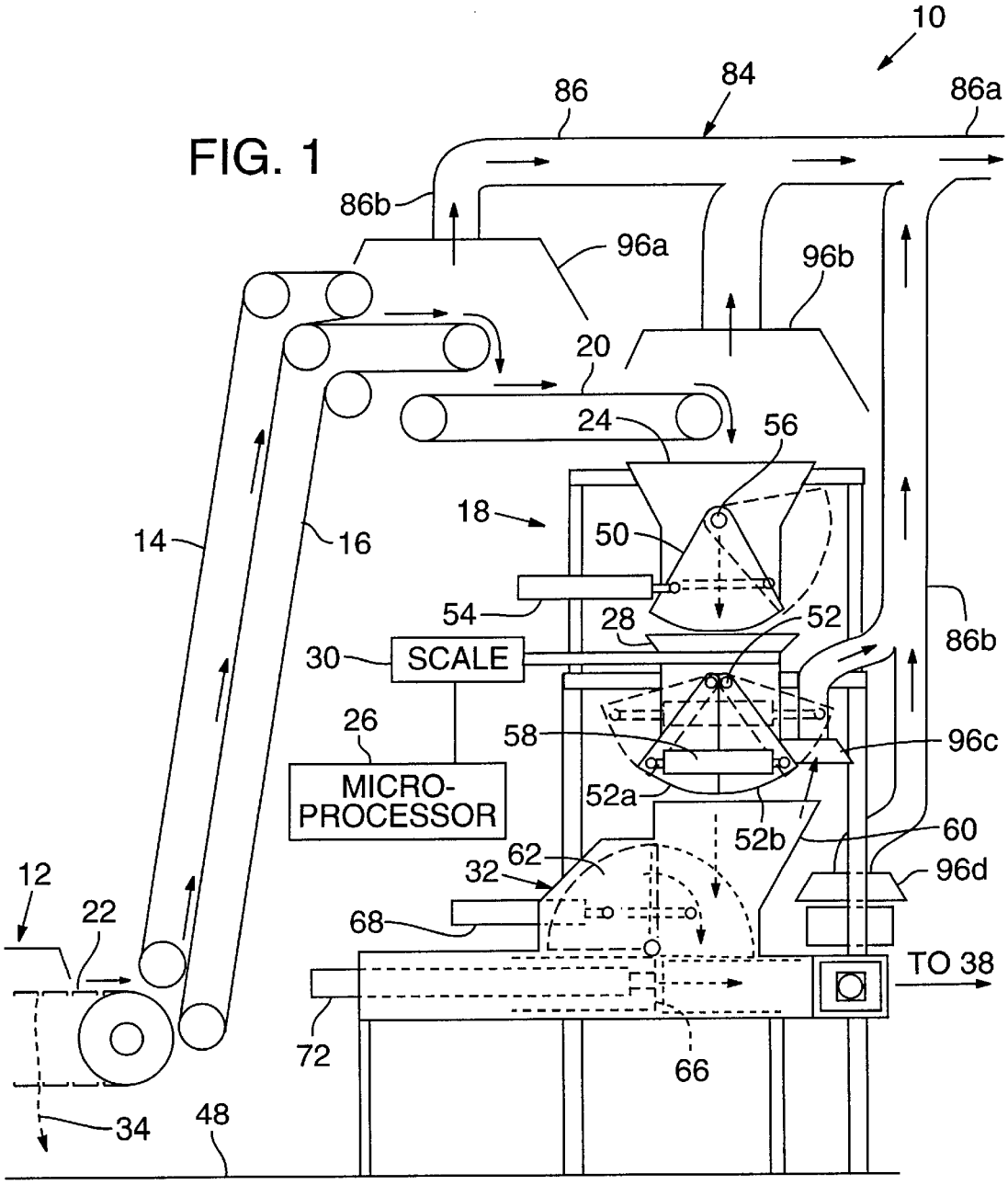
FIG. 1 is an elevational, partially schematic view of a preferred embodiment of a fiber baling apparatus of the present invention.

As illustrated in FIG. 1, a preferred embodiment of a fiber baling apparatus 10 according to the invention, comprises transport conveyors 14, 16 located downstream of a fiber-forming chain 12, and a baler 18 located downstream of a separating conveyor 20. The baler 18 comprises a first hopper 24, a second hopper 28, and a compression assembly 32. A fiber bale storage assembly 38 includes bagger/strapper 36 provided downstream of the baler, and a bag sealer 40 provided downstream of the bagger/strapper 36. Alternative embodiments of the present invention include a third conveyor 82 positioned downstream of the bag sealer 40, and a bale lifting system 46 for placing bagged, strapped, and sealed fiber bales 48 on a pallet (not shown) for shipping and/or storage.

The fiber-forming chain 12 includes any of various conventional apparatus for forming discontinuous fibers of, for example, glass or polymer. After the fibers are produced, they are preferably deposited in a loose mat on an articulated conveyor 22. As illustrated in FIG. 1, the articulated conveyor 22 is not a continuous belt or felt. Rather, the articulated conveyor 22 comprises a series of separate plates 34 connected end-to-end to facilitate separation of the continuous, loose fiber mat into a series of discrete mat portions, as described below.

The transport conveyors 14, 16 are located immediately adjacent to and downstream of the articulated conveyor 22. The transport conveyors 14, 16 comprise two conveyors in which the belts are directly opposed to and in intimate contact with one another. Each transport conveyor 14, 16 is preferably a continuous belt or felt for transporting fiber mat portions from the fiber-forming chain 12 to the baler 18. However, the transport conveyors 14, 16 may comprise multiple belts or felts disposed in series. The transport conveyors 14, 16 extend from the fiber-forming chain 12 to the baler 18.

The transport conveyors 14, 16 extend along an upward incline. The incline angle is sufficiently steep to transport and raise the fiber material to a location sufficiently higher than the first hopper 24 of the baler 18. Although not critical, transport conveyors 14, 16 are preferably at an angle sufficiently steep to minimize run length measured parallel to the floor.

A separating conveyor 20 extends substantially parallel to the floor 48, extending from the transport conveyors 14, 16 to a second end positioned immediately above the first hopper 24 of the baler 18. A first end of the separator conveyor 20 is positioned slightly below the transport conveyor 16 such that the conveyor 16 overlaps the separating conveyor 20. To separate the fiber material into separate mat portions, the separating conveyor 20 is run at a slightly faster speed compared to transport conveyors 14, 16. As the stream of fibers is delivered to the separating conveyor 20, the relatively faster speed of the separating conveyor pulls the fiber stream into separate fiber mat portions. The separate fiber mat portions are then transported along the separating conveyor 20 to the first hopper 24 of the baler 18.

The baler 18 includes a first hopper 24 and a second hopper 28. The second hopper 28 is preferably located directly beneath the first hopper 24. A first gate 50 is positioned between the first and second hoppers to facilitate controlled delivery of fibers from the first hopper 24 to the second hopper 28. The first gate 50 is depicted in FIG. 1 in a closed position by solid lines and in an opened position by dashed lines. The first gate 50 is, preferably, pneumatically operated by a cylinder 54 to pivot about a fulcrum 56 between the opened and closed positions.

A second hopper 28 is positioned below the first gate 50. The second hopper 28 is mounted on a gravimetric scale 30 or analogous means for weighing the mass of fiber mat portions delivered to the second hopper. The second hopper 28 includes a second gate 52 for controlled delivery of the contents from the second hopper 28 to a compression assembly 32. In a preferred embodiment of the present invention, the second gate 52 is pneumatically operated by a cylinder 58. Although the second gate 52 may comprise any conventional type gate, the second gate 52 preferably comprises two swinging gate members 52*a*, 52*b* that synchronously pivot about the same fulcrum in opposing directions, in a clamshell manner, to an opened position (depicted by dashed lines in FIG. 1) and toward one another to a closed position (depicted by solid lines in FIG. 1). The clamshell configuration of the second gate 52 is advantageous as the opposing swing of gate members 52*a* and 52*b* aid in the retention of a fixed center of gravity of the second hopper 28. Retention of a fixed center of gravity prevents undesirable jostling or disturbance of the scale 30 upon which the second hopper 28 is mounted. Additionally, the clamshell configuration of the second gate 52 limits the vibration of the rest of the baler apparatus during opening and closing of the second gate 52. The second gate 52 is fabricated of a light-weight material to avoid excess weight being placed on the scale 30.

The compression assembly 32 is positioned directly beneath the second gate 52 of the second hopper 28 to receive fiber material from the second hopper whenever the second gate 52 is in an open position (dashed lines in FIG. 1). Compression assembly 32 includes, a receptacle 60 and a pivot ram 62 (FIGS. 1 and 3–6). The compression receptacle 60 is open along its top portion and is located immediately below the second gate 52 to receive fiber mat portions from the second hopper 28. The top portion of receptacle 60 preferably extends a distance beyond either side of the second hopper 28 to both ensure receiving the entire fiber mat portion from the second hopper and to allow air to escape the compression assembly 32 as the fiber material is precompressed and then fully compressed. The pivot ram 62 is preferably driven by a hydraulically operated pivot ram cylinder 68 to pivot about a fulcrum from a non-compression position, illustrated by solid lines in FIGS. 1 and 3, to a precompression position, illustrated by solid lines in FIGS. 1 and 4.

The compression assembly 32 also includes a lateral ram 66. In an embodiment of the present invention, the lateral ram 66 is hydraulically driven in a lateral direction preferably by a pneumatic cylinder 72. Accordingly, the compression assembly 32 effects compression of the fiber mat portions in two directions (i.e., vertically by the pivot ram 62 and horizontally by the lateral ram 66). The lateral ram 66 is illustrated in three positions, a non-compression position (FIGS. 3 and 4), a precompression position (FIG. 5), and a full compression position (FIG. 6)). The position of the lateral ram 66 changes with each cycle of the process, as described below. The degree of compression effected by the lateral ram 66 may be adjusted to avoid over-compression and damage to the fibers and to form each bale in a desired size and shape.

In a preferred embodiment of the present invention, a second lateral ram or discharge ram 76 (FIGS. 3–6) is employed for discharging the compressed bale from the compression assembly 32 to the bagger/strapper assembly 36. The discharge ram 76 is preferably hydraulically operated by a cylinder 80.

Figure 2:
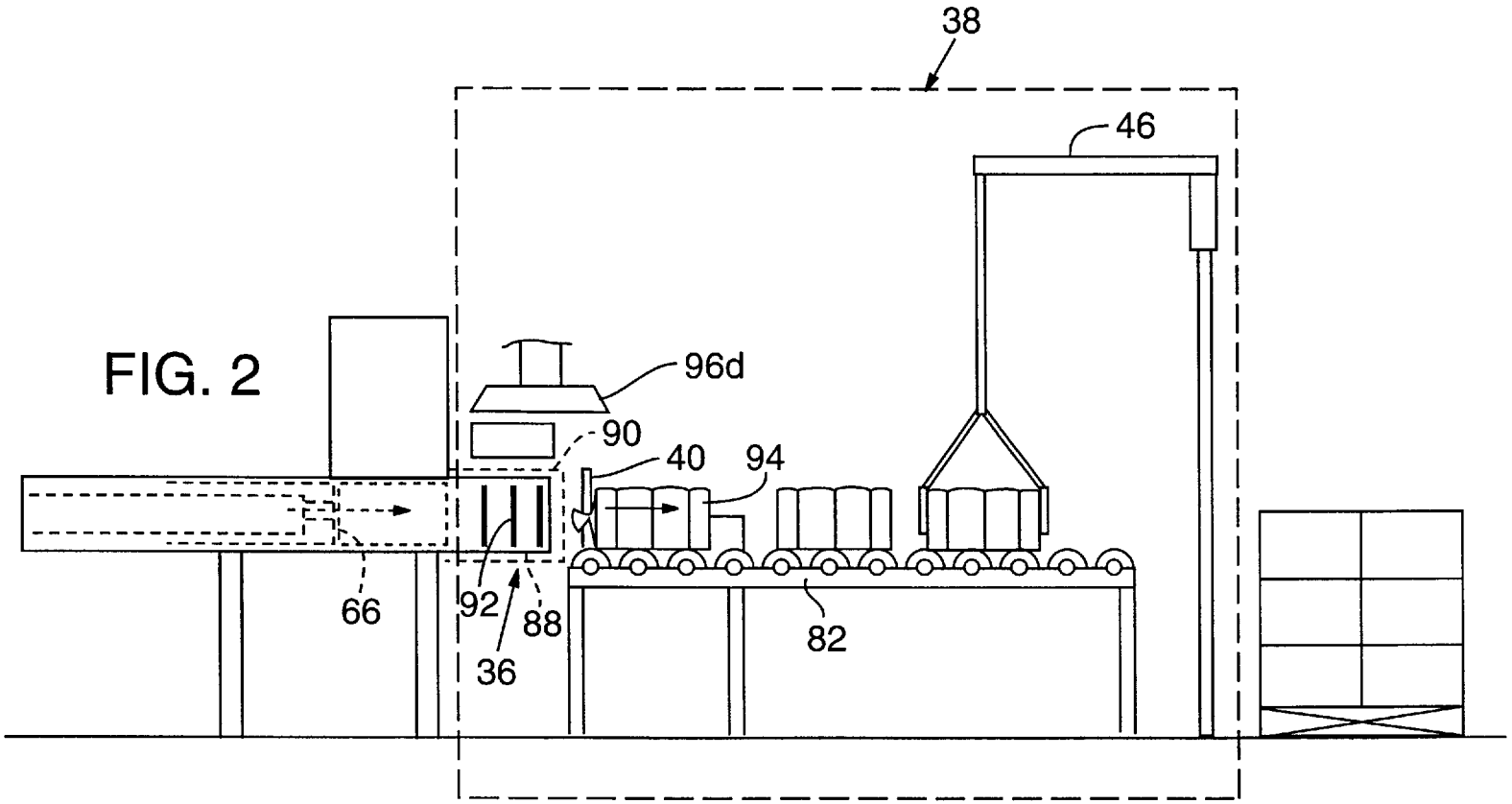
FIG. 2 an elevational, partially schematic view of a fiber bale storage assembly of the fiber baling apparatus of FIG. 1.

Referring to FIG. 2, the bagger/strapper assembly 36 includes a sleeve 88 over which is placed a plastic or paper bag 90. As the compressed bale is discharged from the compression assembly 32 by the discharge ram 76, the bale is forced out of the sleeve 88 and into the bag 90. Straps 92, placed around the bag 90 while the bag is on the sleeve 88, strap the bag onto the discharged fiber bale 94.

A third, substantially horizontal, conveyor 82 extends from the bagger/strapper assembly 36 to a bale lifting system 46 (FIG. 2). As the bales begin transport down the third conveyor 82, a sealer apparatus 40 (FIG. 2) seals the open end of each bag 90, thereby moisture-sealing the fiber bales 94 as the bales are transported along the third conveyor 82. The third conveyor 82 is, preferably, a roller conveyor but may comprise any conventional conveyor for transporting the bagged/strapped fiber bales 94 from the sealer 40 to a position where the bales may be automatically or manually removed from the fiber baling apparatus 10 for shipment or storage.

As shown in FIG. 1, the fiber baling apparatus 10 preferably includes a dust-collection system 84. The dust-collection system 84 includes a tubular duct 86 connected at a first end 86*a* to a vacuum source (not shown). The duct 86 comprises branches 86*b* connected to respective dust-collection vents 96*a*–96*d* positioned in various locations in the fiber baling apparatus 10.

In a preferred embodiment, a first dust-collection vent 96*a* is positioned to scavenge dust released by transfer of fiber mat portions from the transport conveyors 14, 16 to the separating conveyor 20. A second dust-collection vent 96*b* is, preferably, positioned to scavenge dust released by transfer of fiber mat portions from the separating conveyor 20 to the first hopper 24. A third dust-collection vent 96*c* is positioned to cover a portion of the compression receptacle 60 to remove fugitive dust emanating from the fiber material during the precompression and compression cycles. A fourth dust-collection vent 96*d* is preferably placed above the sleeve 88 (FIG. 2) to collect dust as the fiber bales 94 are discharged into the bags 90. Other dust-collection vents may be strategically placed to remove fugitive dust as needed.

In a preferred embodiment, the dust-collection system 84 removes fugitive-dust emanating from the above described locations and transports the fiber dust back to the fiber-forming chain 12. Accordingly, fiber dust is not only removed from the environment, the fiber dust is recycled into new fiber material. The dust-collection system 84 provides a safer and cleaner work environment by reducing air contamination in the work area. Additionally, the dust-collection system 84 reduces the risk of fiber contamination by removing other air-borne particulates that may otherwise settle on the fiber being transported through the fiber baling apparatus 10.

A bale lifting system 46, preferably including an automatic clamping and lifting system (details not shown), is positioned to remove the sealed fiber bales 94 from the third conveyor 82.

Operation

Figure 7:
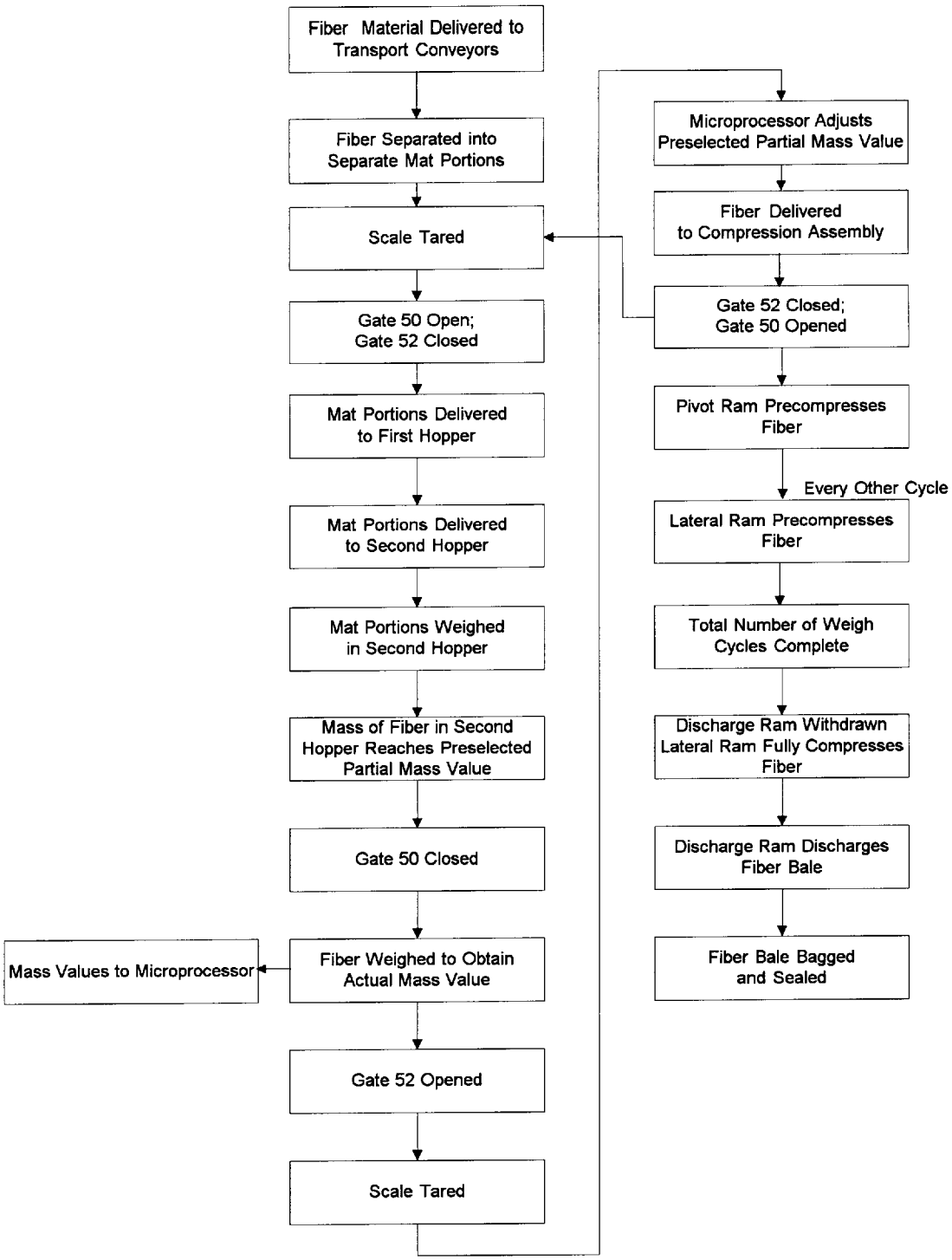
FIG. 7 illustrates a preferred embodiment of a method for forming fiber bales according to the present invention.

A preferred method of the present invention is illustrated in the process flow diagram of FIG. 7.

A fiber material is first formed in the fiber-forming chain 12 (FIG. 1). The fiber material is then transported as a loose mat on the articulated conveyor 22 to the transport conveyors 14, 16. Upon reaching the end of the articulated conveyor 22, the fiber mat is sandwiched between the transport conveyors 14, 16 and is transported to a position immediately above one end of the separating conveyor 20. To facilitate separation of the fiber mat into separate mat portions, prior to delivery to the baler 18, the separating conveyor 20 is operated a slightly faster speed relative to the transport conveyors 14, 16. Consequently, as the fiber material falls from the transport conveyor 16 to the separating conveyor 20, the fiber material is separated into discreet fiber mat portions. Separation of the fiber material into discreet fiber mat portions is important for the production of fiber bales having precise and substantially identical mass values, as discussed above.

The separate fiber mat portions are then transported along the length of the separating conveyor 20 to a position immediately above the first hopper 24 of the baler 18. The transport conveyors 14, 16 and separating conveyor 20 are operated in a continuous fashion to transport and separate fiber material into discreet mat portions and deliver the fiber mat portions to the baler 18. The baler 18 then forms a fiber bale through a process including a number of repeat cycles (see FIG. 7).

Operation of each subassembly of the fiber baling apparatus 10 is controlled via a microprocessor 26 or similar control system. Accordingly, although the transport conveyors 14, 16 and the separating conveyor 20 are generally operated in a continuous fashion, the conveyors may be sped up, slowed or stopped via signals generated by the microprocessor 26 when necessary for suitable coordination of operation with other subassemblies of the fiber baling apparatus 10.

A first cycle of the method of the present invention occurs when the scale 30 is tared while the second hopper 28 is substantially empty to allow for the weight of the second hopper 28 and any residual fiber material remaining therein. As the fiber mat portions are delivered to the first hopper 24, the first gate 50 is in the opened position and the second gate 52 is in the closed position. Accordingly, fiber mat portions fall from the first hopper 24 to the second hopper 28.

The mass of the fiber mat portions delivered to the second hopper 28 is continuously monitored via signals from the scale 30 to the microprocessor 26. The first gate 50 remains in the opened position until a preselected, partial mass value of fiber material is delivered to the second hopper 28. The preselected partial mass value is a fraction of the desired total mass of the resulting fiber bale. For example, if a fiber bale having a total mass value of 50 lbs is desired, the preselected partial mass value would, preferably, be about 5 lbs. Accordingly, fiber mat portions are delivered to the second hopper 28 until this preselected partial mass value of fiber material is contained therein. The partial mass value is adjusted by the microprocessor 26 as necessary to ensure a resulting fiber bale having the desired total mass value. Put another way, if the first five weighed fiber portions were 5.1 lbs, 5.0 lbs, 5.3 lbs, 5.1 lbs, and 5.2 lbs, respectively, then the subsequent partial mass value may be adjusted by the microprocessor 26 to about 4.8 lbs to ensure a resulting fiber bale total mass value of 50 lbs. The adjustment of the partial mass value occurs after each fiber portion is weighed until the desired total weight value is reached.

When the preselected partial mass value of fibers is delivered to the second hopper 28, the first gate 50 is moved to the closed position and the fiber material in the second hopper 28 is weighed to determine the final partial mass value. The final partial mass value of the fiber material is recorded by the microprocessor 26 and an adjustment to the preselected partial mass value is made, if necessary.

Figure 3:
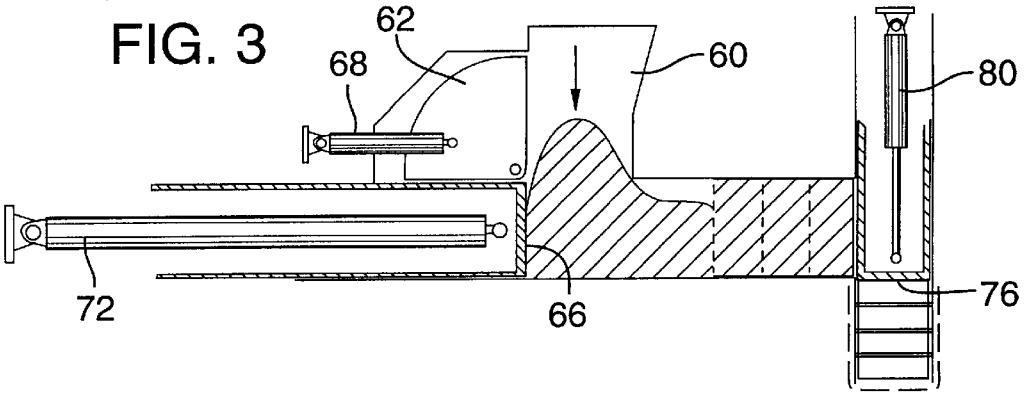
FIG. 3 is an enlarged, partially sectional view depicting a compression subassembly of the fiber baling apparatus of FIG. 1, showing the fiber material prior to precompression.

The second gate 52 is then moved to the opened position and the fiber material is delivered from the second hopper 28 to the receptacle 60 of the compression assembly 32 (FIG. 3). The second gate 52 is moved to the closed position and the scale 30 is again tared in preparation to receive the next batch of fiber material in the second hopper 28. The first gate 50 is moved to the opened position and the weighing cycle is repeated again until the preselected partial mass value of fiber material is again delivered to the second hopper 28.

Figure 4:
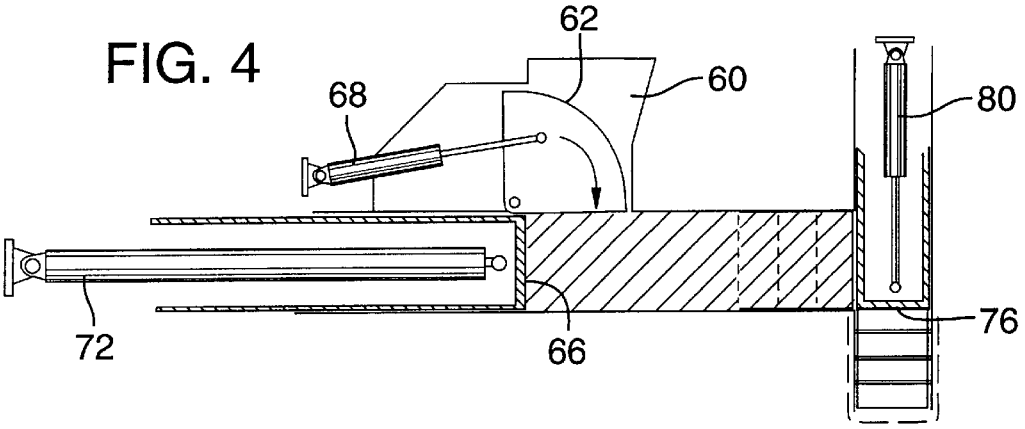
FIG. 4 is an enlarged, partially sectional view depicting the compression assembly of FIG. 3 showing precompression of the fiber material by movement of a pivot ram.

As the next weighing cycle begins, the fiber material delivered to the receptacle 60 of the compression assembly 32 is precompressed. A first step of the precompression takes place through the pivoting motion of the pivot ram 62 (FIG. 4). Specifically, the pivot ram 62 is normally in the open or non-compression position, as illustrated in FIG. 3. After fiber material is delivered to the receptacle 60, the pivot ram cylinder 68 moves the pivot ram 62 to a closed or precompression position, as illustrated in FIG. 4.

Figure 5:
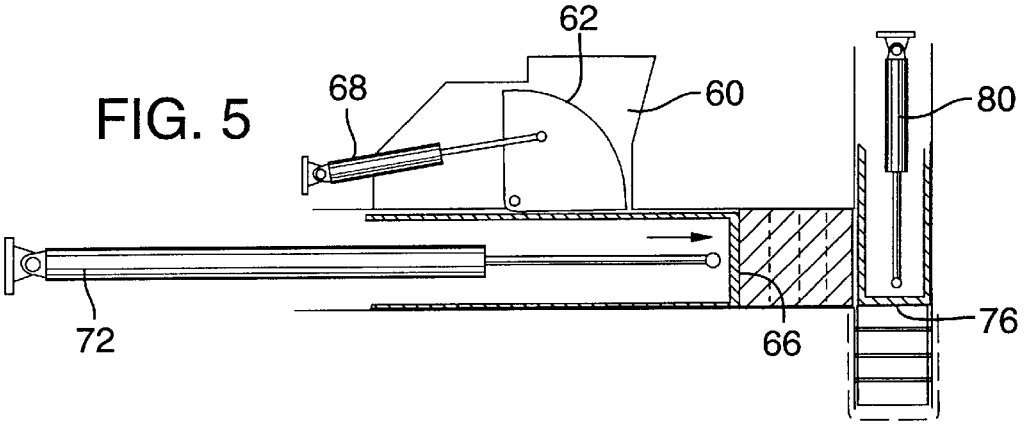
FIG. 5 is an enlarged, partially sectional view depicting the compression assembly of FIG. 3 showing precompression of the fiber material by movement of the pivot ram and a lateral ram.

The lateral ram 66 remains in a completely open or non-compression position, as shown in FIGS. 3 and 4, as the pivot ram 62 is moved to the precompression position. Every other cycle of precompression by the pivot ram 62, the lateral ram 66 is moved by the cylinder 72 to a lateral ram precompression position in order to further precompress the fiber material (FIG. 5). Accordingly, the fiber material is precompressed in both a vertical direction (by the pivot ram 62) and a horizontal direction (by the lateral ram 66).

The precompression step described above facilitates formation of the fiber material portions into what will be a resulting fiber bale comprised of numerous weighed and precompressed fiber material portions. Additionally, during precompression, air in the fiber material is allowed to escape from the baling apparatus 10 via the top portion of the receptacle 60 (see FIG. 1).

Figure 6:
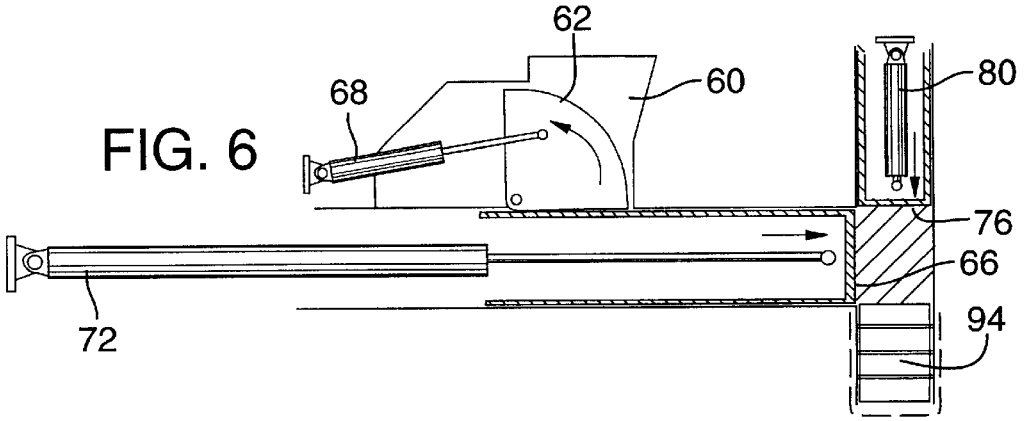
FIG. 6 is an enlarged, partially sectional view depicting the compression assembly of FIG. 3 showing full compression of the fiber material into a fiber bale.

During the precompression cycles, the discharge ram 76 remains in a closed or discharged position (FIGS. 3–5). After the total number of weighing and precompression cycles is completed (i.e., the partial mass values of the fiber material portions total the desired final fiber bale mass value) the discharge ram 76 is moved by the cylinder 80 to an opened or non-discharged position, as illustrated in FIG. 6. The lateral ram 66 is then moved to the full compression position (FIG. 6) and all of the fiber material portions are fully compressed into a fiber bale 94.

Simultaneously with the full compression cycle, the partial mass values of the fiber material portions are added by the microprocessor 26 and the total mass value of the resulting fiber bale is recorded.

Following full compression of the fiber bale 94, the bale is laterally moved by the discharge ram 76 through the sleeve 88 and into the bag 90 and straps 92. The fiber bale 94 is then transported by the conveyor 82 to a conventional bag sealer apparatus 40 where the bag is sealed. Following sealing of the bag 90, the fiber bale 94 is further transported on the conveyor 82 to the bale lifting system 46. The automatic clamping assembly of the lifting system 46 lifts and relocates the fiber bale 94 onto a pallet for shipment or storage.

In a preferred embodiment of the present invention, each conveyor (14, 16 and 20) has covered sides to reduce the risk of contamination of the fiber material. Additionally, as the fiber portions are transported through the fiber baling apparatus 10 of the present invention, the dust-collection system 84 removes fugitive-dust emanating from the moving fiber material and returns the fiber dust to the fiber forming chain for recycling into the next batch of fiber material.

Having illustrated and described the principles of the invention with several preferred embodiments, it should be apparent to those skilled in the art that the invention can be modified in arrangement and detail without departing from such principles. We claim all the modifications coming within the spirit and scope of the following claims.

I claim:

1. A fiber baling apparatus comprising:

a conveyor system for separating a continuous stream of fiber material into separate fiber mat portions, the conveyor system including a first conveyor and a second conveyor positioned downstream of the first conveyor; and a baler including:

a receptacle positioned downstream of the conveyor system for collecting the fiber mat portions;

a scale upon which a portion of the receptacle is mounted, the scale operable to determine the mass values of the fiber mat portions;

a compression assembly positioned downstream of the receptacle for receiving the fiber mat portions from the receptacle and compressing the fiber mat portions into fiber bales having precise and substantially identical mass values; and a discharge ram operable to discharge the fiber bale from the compression assembly.

2. The apparatus of claim 1, wherein the first conveyor moves at a first speed and the second conveyor moves at a second speed, the second speed being faster than the first speed so that the fiber material on the first conveyor is separated into discreet fiber mat portions on the second conveyor.

3. The apparatus of claim 2, wherein the receptacle includes a first hopper located downstream of the second conveyor for receiving the separate fiber mat portions, the first hopper having a first gate, and a second hopper mounted on the scale and located below the first gate for receiving fiber mat portions from the first hopper, the second hopper having a second gate for releasing fiber mat portions from the second hopper.

4. The apparatus of claim 3, wherein the second gate further comprises a pneumatically operated gate having a clamshell configuration.

5. The apparatus of claim 2, wherein the compression assembly includes a pivot ram for precompressing fiber mat portions delivered from the second hopper to the compression assembly.

6. The apparatus of claim 5, wherein the compression assembly further includes a lateral ram operable to precompress and then fully compress the fiber mat portions delivered from the second hopper to the compression assembly, into a fiber bale.

7. The apparatus of claim 6, further comprising a microprocessor connected to and operable to control coordinated operation of the conveyor system, the first gate, the scale, the second gate, and the compression system.

8. The apparatus of claim 1, wherein the discharge ram is operable to discharge the fiber bale into a fiber bale bag.

9. The apparatus of claim 1, wherein the scale is connected to and controlled by a microprocessor.

10. The apparatus of claim 1, further including a dust-collection system situated proximal to the conveyor system, baler, and compression assembly for collecting fugitive-dust emanating from the fiber mat portions as the fiber mat portions are transported, weighed, and compressed by the conveyor system, baler, and compression assembly.

11. The apparatus of claim 10, wherein the dust-collection system delivers the fugitive-dust collected from the conveyor system, baler, and compression assembly to the fiber material.

12. A fiber baling apparatus comprising:

a conveyor system for separating a continuous stream of fiber material into separate fiber mat portions;

a baler including:

a scale connected to and controlled by a microprocessor, the scale positioned downstream of the conveyor system for collecting and weighing the fiber mat portions;

a compression assembly connected to and operated by the microprocessor, the compression assembly positioned downstream of the scale for receiving the fiber mat portions from the receptacle and compressing the fiber mat portions into fiber bales having precise and substantially identical mass values; and a discharge ram operable to discharge the fiber bale from the compression assembly.

13. The apparatus of claim 12, wherein the conveyor system includes a first conveyor moving at a first speed for transporting fiber material to a second conveyor positioned downstream of the first conveyor, the second conveyor moving at a second speed, the second speed being faster than the first speed so that the fiber material on the first conveyor is separated into discreet fiber mat portions on the second conveyor.

14. The apparatus of claim 13, further including a first hopper located downstream of the second conveyor for receiving the separate fiber mat portions, the first hopper having a first gate, and a second hopper mounted on the scale and located below the first gate for receiving fiber mat portions from the first hopper, the second hopper having a second gate.

15. The apparatus of claim 14, wherein the compression assembly includes a pivot ram for precompressing fiber mat portions delivered from the second hopper to the compression assembly and a lateral ram operable to precompress and fully compress the fiber mat portions delivered from the second hopper to the compression assembly, into a fiber bale.

16. The apparatus of claim 14, wherein the microprocessor is further connected to and controls the operation of the conveyor system, the first gate, the second gate, and the compression system.

* * * * *